US010256016B2

(12) United States Patent
Fujikawa et al.

(10) Patent No.: US 10,256,016 B2
(45) **Date of Patent: *Apr. 9, 2019**

(54) RARE EARTH BASED MAGNET

(71) Applicant: TDK CORPORATION, Tokyo (JP)

(72) Inventors: Yoshinori Fujikawa, Tokyo (JP); Yuki Nagamine, Tokyo (JP); Wakako Okawa, Tokyo (JP); Chikara Ishizaka, Tokyo (JP); Eiji Kato, Tokyo (JP); Katsuo Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 525 days.

This patent is subject to a terminal disclaimer.

(21) Appl. No.: 14/578,621

(22) Filed: Dec. 22, 2014

(65) Prior Publication Data

US 2015/0179317 A1 Jun. 25, 2015

(30) Foreign Application Priority Data

Dec. 20, 2013 (JP) ..... 2013-263366

(51) Int. Cl.
*H01F 1/057* (2006.01)

(52) U.S. Cl.
CPC ..... *H01F 1/057* (2013.01); *H01F 1/0577* (2013.01)

(58) Field of Classification Search
CPC ..... H01F 1/057; H01F 1/0577
USPC ..... 148/302
See application file for complete search history.

(56) References Cited

U.S. PATENT DOCUMENTS

| | | | | |
|---|---|---|---|---|
| 4,888,068 | A | 12/1989 | Tokunaga et al. | |
| 2012/0024429 | A1 | 2/2012 | Hayakawa et al. | |
| 2012/0145944 | A1 | 6/2012 | Komuro et al. | |
| 2012/0235778 | A1 | 9/2012 | Kunieda et al. | |
| 2013/0092868 | A1* | 4/2013 | Nakajima | C22C 38/005 252/62.51 R |
| 2014/0019833 | A1 | 1/2014 | Bae et al. | |
| 2014/0132377 | A1 | 5/2014 | Nakajima et al. | |
| 2015/0179318 | A1* | 6/2015 | Fujikawa | C22C 38/001 420/83 |
| 2015/0179319 | A1* | 6/2015 | Fujikawa | H01F 1/0577 420/83 |

FOREIGN PATENT DOCUMENTS

| | | | |
|---|---|---|---|
| CN | 102376407 | A | 3/2012 |
| CN | 102693812 | A | 9/2012 |

(Continued)

*Primary Examiner* — Jie Yang
(74) *Attorney, Agent, or Firm* — Oliff PLC

(57) ABSTRACT

The present invention provides a rare earth based magnet in which the demagnetization rate at a high temperature can be inhibited even if the amount of heavy rare earth element(s) such as Dy and Tb is evidently decreased compared to the past or no such heavy rare earth element is used. The rare earth based magnet of the present invention is a sintered magnet which comprises $R_2T_{14}B$ crystal grains as the main phases and the crystal boundary phases among the $R_2T_{14}B$ crystal grains. The microstructure of the sintered body is controlled by including crystal boundary phases containing at least R, T and M in the crystal boundary phases, wherein the relative atomic ratios of R, T and M are as follows, i.e., 25 to 35% for R, 60 to 70% for T and 2 to 10% for M.

10 Claims, 4 Drawing Sheets

(56) References Cited

FOREIGN PATENT DOCUMENTS

| | | | | | |
|---|---|---|---|---|---|
| JP | 2002327255 | A | | 11/2002 | |
| JP | 2011-216678 | A | | 10/2011 | |
| JP | 2012015168 | A | | 1/2012 | |
| JP | 2012015169 | A | | 1/2012 | |
| JP | WO 2012002060 | A1 | * | 1/2012 | ..... C22C 38/005 |
| JP | 2012-212808 | A | | 11/2012 | |
| JP | 2013-013870 | A | | 1/2013 | |
| JP | 2013-045844 | A | | 3/2013 | |
| WO | 2013008756 | A1 | | 1/2013 | |

* cited by examiner

RARE EARTH BASED MAGNET

The present invention relates to a rare earth based magnet, especially a rare earth based magnet in which the microstructure of the R-T-B based sintered magnet is controlled.

BACKGROUND

The R-T-B based sintered magnet (R represents a rare earth element, T represents at least one iron family element with Fe as essential, and B represents boron) represented by the Nd—Fe—B based sintered magnet has a high saturation magnetic flux density. Thus, it is useful for the minimization and efficiency improvement of the equipments used and can be used in a voice coil motor of a hard disk drive. Recently, such magnets are also applied to motors in various fields or drive motors for hybrid vehicles. From the view point of energy saving or the like, it is desired that more such magnets will be used in these fields. However, during the application of R-T-B based sintered magnets in hybrid vehicles or the like, the magnets are exposed to a relatively high temperature. In this respect, it is important to inhibit the demagnetization at a high temperature caused by heat. Further, it is well known that the demagnetization at a high temperature can be effectively inhibited by sufficiently improving the coercivity (Hcj) of the R-T-B based sintered magnet at room temperature.

For example, as a well known method for improving the coercivity of the Nd—Fe—B based sintered magnet at room temperature, part of Nd in the $Nd_2Fe_{14}B$ compound (which is the main phase) is replaced with the heavy rare earth element(s) such as Dy or Tb. The magneto-crystalline anisotropy constant can be improved by replacing part of Nd with the heavy rare earth element(s). As a result, the coercivity of the Nd—Fe—B based sintered magnet at room temperature can be improved sufficiently. Besides the replacement of heavy rare earth element(s), the addition of Cu or the like will also elevate the coercivity at room temperature (Patent Document 1). The addition of Cu will render Cu form, for example, the Nd—Cu liquid phase in the crystal boundary so that the crystal boundary will become smooth. In this way, the reverse magnetic domains can be prevented from generating.

On the other hand, Patent Documents 2, 3 and 4 have disclosed a technology that the crystal boundary phase (which is the microstructure of the rare earth based magnet) is controlled to improve the coercivity. It can be known from the drawings of these Patent Documents that the crystal boundary phases refer to the crystal boundary phases surrounded by three or more main phase crystal grains and are also called the triple junction points. In Patent Document 2, a technology has been disclosed for forming two kinds of triple junction points with different Dy concentrations. That is, it has been disclosed that crystal boundary phases (triple junction points) are formed with part areas having a high concentration of Dy and the total concentration of Dy unchanged so that a high resistance with respect to the reversal of the magnetic domain can be maintained. The Patent Document 3 has disclosed a technology that three kinds of crystal boundary phases (triple junction points) (the first one, second one and third one) are formed with different total atomic concentrations of rare earth elements, wherein the atomic concentration of rare earth elements in the third crystal boundary phase is lower than that in other two crystal boundary phases, and the atomic concentration of Fe in the third crystal boundary phase is higher than that in other two crystal boundary phases. In this way, a third crystal boundary phase with a high Fe concentration can be formed in the crystal boundary phases, resulting in the improvement of coercivity. In addition, Patent Document 4 has disclosed an R-T-B based rare earth based sintered magnet which is formed by a sintered body, and the sintered body consists of main phases (which mainly contains $R_2T_{14}B$) and crystal boundary phases with more R than the main phases. The crystal boundary phases contain phases with the total atomic concentration of rare earth elements being 70 atomic % or more and phases with the total atomic concentration of rare earth elements being 25 to 35 atomic %. The phases with the total atomic concentration of rare earth elements being 25 to 35 atomic % are referred to as the transition metal-rich phases, and the atomic concentration of Fe in these phases are preferably 50 to 70 atomic %. In this respect, coercivity is improved.

PATENT DOCUMENTS

Patent Document 1: JP2002-327255
Patent Document 2: JP2012-15168
Patent Document 3: JP2012-15169
Patent Document 4: International Publication Pamphlet No. 2013/008756

SUMMARY

When an R-T-B based sintered magnet is used at a high temperature such as 100° C. to 200° C., the value of coercivity at room temperature is one of the effective indexes. However, it is important to inhibit the occurrence of demagnetization or to have a low demagnetization rate when the magnet is actually exposed to a high temperature environment. When part of R in the $R_2T_{14}B$ compound (i.e., the main phase) is replaced with a heavy rare earth element such as Tb or Dy, the coercivity at room temperature is evidently improved. It is an easy way to improve the coercivity, but the source of the heavy rare earth elements such as Dy and Tb may be problematic because the places of origin and outputs are limited. With such replacements, the decrease of residual flux density is unavoidable due to for example the antiferromagnetic coupling of Nd and Dy. Further, the addition of Cu as described above and the like are also effective to improve the coercivity. However, in order to extend the applicable fields for the R-T-B based sintered magnets, the demagnetization at a high temperature (the demagnetization caused by the exposure to a high temperature environment) is expected to be further inhibited.

Besides the addition of Cu, it is well known that it is important to control the crystal boundary phases which are the microstructure if the coercivity of the rare earth based magnets (i.e., the R-T-B based sintered magnets) is to be improved. In the crystal boundary phases, there are the so-called two-grain boundary phases formed between two adjacent main phase crystal grains and the so-called triple junction points surrounded by three or more main phase crystal grains. As mentioned below, the triple junction point is simply referred to as the crystal boundary phase hereinafter in this specification.

However, it is well known that the coercivity at room temperature is highly improved with the replacement of heavy rare earth elements such as Dy and Tb but the magneto crystalline anisotropy constant (the main factor for the coercivity) dramatically changes as the temperature varies. That is, when the temperature becomes high in the environment where rare earth based magnets are used, the coercivity dramatically decreases. Thus, the inventors have found that it is important to control the microstructure as shown below to obtain a rare earth based magnet with demagnetization at a high temperature being inhibited. If the coercivity can be improved by controlling the microstructure of the sintered magnets, the obtained rare earth based magnet will have excellent temperature stability.

If the coercivity of the rare earth based magnet is to be improved, it is important to cut off the magnetic coupling among $R_2T_{14}B$ crystal grains (which are the main phases). If the major crystal grains can be magnetically isolated, the adjacent crystal grains will not be affected even if reverse magnetic domains are generated in some certain crystal grains. In this respect, the coercivity can be improved. In Patent Documents 2, 3 and 4, the coercivity is improved by forming several kinds of crystal boundary phases (triple junction points) with different constitutions. However, it is not clear what kind of structure of the crystal boundary phases (triple junction points) will result in sufficient magnetic isolation among main phase crystal grains. Especially in the technologies disclosed in Patent Documents 3 and 4, crystal boundary phases with a lot of Fe atoms are formed. With only such a structure, the magnetic coupling among main phase crystal grains may not be sufficiently inhibited.

The inventors of the present invention believe that it is important to control the crystal boundary phases (triple junction points) during the formation of the two-grain boundary phases with good effect on cutting off the magnetic coupling between adjacent crystal grains. In this respect, kinds of conventional rare earth based magnets have been studied. For example, if nonmagnetic two-grain boundary phases can be formed with a relatively high concentration of the rare earth element R by increasing the ratio of R (which is a constituent of the magnet), sufficient effect on cutting off the magnetic coupling can be expected. Actually, if only the ratio of R (which is a constituent of the alloy raw materials) is elevated, the concentration of the rare earth element R in the two-grain boundary phases will not become higher and the ratio occupied by the crystal boundary phases (triple junction points) with a relatively high concentration of the rare earth element R is increased. Thus, dramatic improvement of the coercivity is not achieved with the residual flux density decreasing to an extreme extent instead. In addition, when the atomic concentration of Fe is increased in the crystal boundary phases (triple junction points), the concentration of rare earth element R has not become higher in the two-grain boundary phases. Thus, the magnetic coupling will not be sufficiently cut off and the crystal boundary phases (triple junction points) will become phases with ferromagnetism. These phases will easily become the nucleation point for the reverse magnetic domains, which is the cause of the decreased coercivity. Thus, it has been realized that the degree of cutting off the magnetic coupling between adjacent crystal grains is not enough in conventional rare earth based magnets having triple junction points.

In view of the problems mentioned above, the present invention aims to significantly inhibit the demagnetization rate at a high temperature in the R-T-B based sintered magnet (i.e., the rare earth based magnet).

In order to significantly inhibit the demagnetization rate at a high temperature, the inventors of the present invention have studied the structure of the main phase crystal grains and triple junction points in the sintered body of the rare earth based magnets, wherein the triple junction points may form two-grain boundary phases which cut off the magnetic coupling between adjacent main phase crystal grains. As a result, the following invention has been completed.

The rare earth based magnet of the present invention is a sintered magnet containing $R_2T_{14}B$ crystal grains (which are the main phases), two-grain boundary phases and triple junction points among $R_2T_{14}B$ crystal grains. When the microstructure of the sintered article is observed at any section and the triple junction points surrounded by three or more main phase crystal grains are referred to as the crystal boundary phases, such crystal boundary phases contain those with at least R, T and M, wherein the relative atomic ratios of R, T and M are as follows. i.e., 25 to 35% for R, 60 to 70% for T and 2 to 10% for M. With such a composition, the absolute value of the demagnetization rate at a high temperature is inhibited to a level below 4%. M represents at least one selected from the group consisting of Al, Ge, Si, Sn and Ga.

More preferably, when the numbers of R, T and M atoms contained in the crystal boundary phase with at least R, T and M are respectively referred to as [R], [T] and [M], [R]/[M]<10 and [T]/[M]<30. The absolute value of the demagnetization rate at a high temperature is inhibited to 3% or less by setting the ratios of the constituents as those mentioned above in the crystal boundary phases containing at least R, T and M.

In the rare earth based magnet of the present invention, by forming such crystal boundary phases as mentioned above, the R-T-M based compound is formed and the T atom such as Fe atoms unevenly distributed in the conventional R—Cu two-grain boundary phases is consumed as the R-T-M based compound. In this respect, the concentration of iron family element(s) in the two-grain boundary phases can be lowered extremely, thus the two-grain boundary phases become phases with non-ferromagnetism. In addition, when the crystal boundary phase is formed with the ratio of T being 60% or more, T can be better consumed as a compound containing T atoms. In addition, the crystal boundary phases will form a compound which contains T and not being ferromagnetism. Accompanied by the concentration decrease of the iron family element in the two-grain boundary phases, the crystal boundary phases magnetically isolate the adjacent main phase crystal grains. In this respect, the demagnetization rate at a high temperature can be inhibited.

In the rare earth based magnet of the present invention, the area ratio of the R-T-M based compound preferably ranges from a level of 0.1% or more to a level less than 20% at the section. When the area ratio of the R-T-M based compound is within the range mentioned above, the effect obtained by containing R-T-M based compound in the crystal boundary phase will be better exerted. In contrast, if the area ratio of the R-T-M based compound is below the range mentioned above, it may become ineffective in decreasing the concentration of the iron family element(s) in the two-grain boundary phases and the coercivity may not be sufficiently improved. Further, the sintered body with the area ratio of the R-T-M based compound being above the range mentioned above will have a decrease in the volume ratio of the $R_2T_{14}B$ main phase crystals and a lowered saturation magnetization and an insufficient residual flux density. In this respect, such a sintered body is not preferable. The details about the method for estimating the area ratio will be described below.

As for the rare earth based magnet of the present invention, M is contained in the sintered body. Crystal boundary phases at least containing R, T and M can be formed in the sintered body by adding the rare earth element R and iron family element T (which are the constituents of the main phase crystal grains) and element M (which forms the ternary eutectic point with R and T). As a result, the concentration of T in the two-grain boundary phases can be lowered. The addition of M facilitates the generation of the R, T and M-containing crystal boundary phase, and the T present in the two-grain boundary phases is consumed during the generation of the crystal boundary phase, which may be the reason why the concentration of T is decreased in the two-grain boundary phases. During the analysis via the high resolution transmission electron microscopy and the electron diffraction patterns, the crystal boundary phase composed of the R-T-M based compound is determined as a crystal phase with a structure of $La_6Co_{11}Ga_3$-type crystals (which has a structure of body centered tetragonal lattice). The crystal boundary phases containing at least elements R, T and M have good crystallinity and form interfaces with the main phase grains, thereby the distortion caused by uneven crystal lattices can be prevented from generating and also the nucleation of the reverse magnetic domains can be prevented. In the sintered magnet, 0.03 to 1.5 mass % of M is contained. If less M is contained, the coercivity will not be enough. If more M is contained, the saturation magnetization will be lowered and the residual flux density will not be sufficient. If better coercivity and residual flux density are to be obtained, 0.13 to 0.8 mass % of M may be contained. After the magnetic flux distribution is analyzed based on the electron microscopy and the electron holography of the crystal boundary phases consisting of R-T-M based compounds, it can be known that the crystal boundary phases become non-ferromagnetic phases which are presumed to be antiferromagnetic or ferrimagnetic with a quite low magnetization value although Fe is contained therein. As the iron family element T is contained as a constituent of the compound, non-ferromagnetic crystal boundary phases are formed even if the iron family elements such as Fe and Co are contained. Thus, it is believed that the nucleation of the reverse magnetic domains can be prevented.

As the element M which promotes the reaction together with R and T (which two elements constitute the main phase crystal grains mentioned above), Al, $Ga_3$, Si, Ge, Sn and the like can be used.

According to the present invention, a rare earth based magnet with a small demagnetization rate at a high temperature can be provided as well as a rare earth based magnet applicable to motors used under high temperature environments.

DETAILED DESCRIPTION OF EMBODIMENTS

Hereinafter, the preferable embodiments of the present invention will be described with reference to the drawings. The rare earth based magnet of the present invention is a sintered magnet comprising main phase crystal grains of $R_2T_{14}B$ and crystal boundary phases, wherein R contains one or more rare earth elements. T contains one or more iron family elements with Fe as essential, and B represents boron. In addition, various well known additive elements are added and inevitable impurities are contained.

Figure 1:
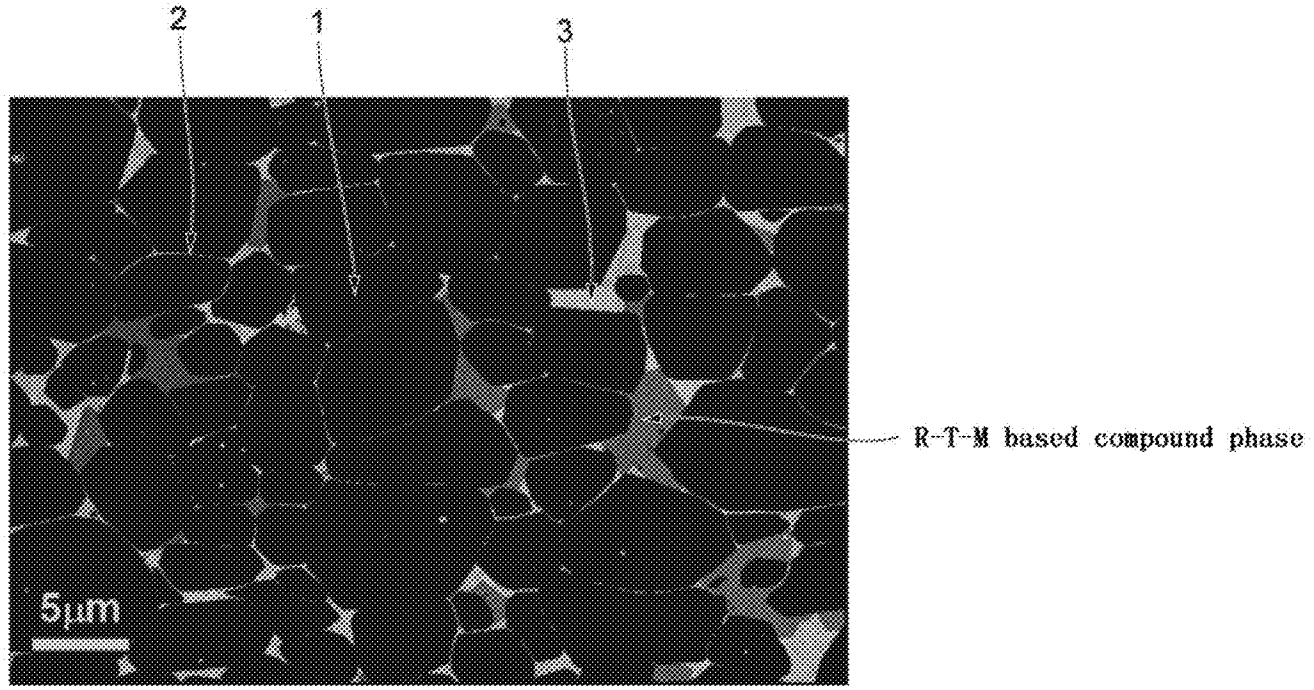
FIG. 1 is an electron micrograph showing the crystal boundary phases at a section of the rare earth based magnet in an embodiment of the present invention (sample 2).
Figure 2:
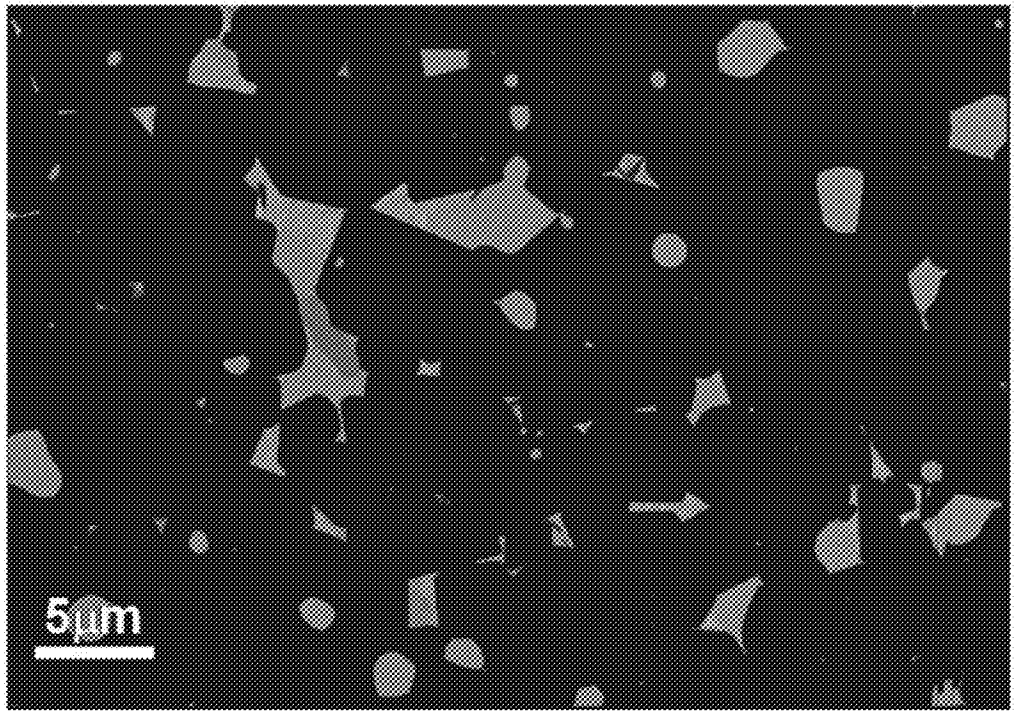
FIG. 2 is an electron micrograph showing the crystal boundary phases at a section of the rare earth based magnet of sample 9 (a comparative example) in the present embodiment.

FIG. 1 is an electron micrograph showing the structure at a section of the rare earth based magnet in an embodiment of the present invention. The rare earth based magnet of the present embodiment comprises the main phase crystal grains 1 of $R_2T_{14}B$, the two-grain boundary phases 2 formed between two adjacent main phase crystal grains 1, and the crystal boundary phases 3 surrounded by three or more main phase grains. The crystal boundary phases 3 at least contain R. T and M, wherein the relative atomic ratios of R, T and M are as follows, 25 to 35% for R, 60 to 70% for T and 2 to 10% for M.

In the main phase crystal grains of $R_2T_{14}B$ which constitute the rare earth based magnet of the present embodiment, the rare earth element R can be any one of the light rare earth element, the heavy rare earth element or their combination. In view of the cost of the materials, Nd or Pr or their combination is preferable. The other elements are as mentioned above. The preferable range for the combination of Nd and Pr will be described below.

The rare earth based magnet of the present embodiment may contain a trace of additive elements. As the additive element, well known additive elements can be used. The additive elements are preferably those having a eutectic composition with R, wherein R is the constituent of the main phase crystal grains of $R_2T_{14}B$. Thus, the additive element is preferred to be Cu. However, other elements can also be used. The proper range for Cu to be added will be described below.

The rare earth based magnet of the present embodiment may further contain Al, Ga, Si, Ge, Sn and the like as the element M which promotes the reaction in the powder metallurgical processes of the main phase crystal grains. The appropriate amount of M to be added will be described below. With the addition of M in the rare earth based magnet, reactions happen in the surface layer of the main phase crystal grains. Thus, the distortions and defects will be eliminated while the generation of the crystal boundary phases containing at least R, T and M will be promoted via the reaction between the element T existing in the two-grain boundary phases and the element M. As a result, the concentration of T is decreased in the two-grain boundary phases.

In the rare earth based magnet of the present embodiment, the amount of each element relative to the total masses is as follows.

R: 29.5 to 33 mass %;
B: 0.7 to 0.95 mass %;
M: 0.03 to 1.5 mass %;
Cu: 0.01 to 1.5 mass %, and
Fe: balance, substantially.

The total content of elements other than Fe occupying the balance: 5 mass % or less.

The R contained in the rare earth based magnet of the present embodiment will be more specifically described. R must contain either one of Nd and Pr. As for the ratio of Nd and Pr in R, the sum of Nd and Pr may accounts for 80 to 100 atomic % or 95 to 100 atomic %. If the ratio is within such a range, good residual flux density and coercivity can be further obtained. In addition, in the rare earth based magnet of the present embodiment, the heavy rare earth element such as Dy, Tb or the like can be contained as R. In this case, as for the amount of the contained heavy rare earth element based on the total mass of the rare earth based magnet, the sum of the heavy rare earth elements accounts for 1.0 mass % or less, and preferably 0.5 mass % or less, and more preferably 0.1 mass % or less. In the rare earth based magnet of the present embodiment, even if the amount of the heavy rare earth elements is decreased, a high coercivity can still be obtained and the demagnetization rate at a high temperature can still be inhibited by rendering the amount and atomic ratio of other elements meet certain requirements.

In the rare earth based magnet of the present embodiment, the amount of B is 0.7 to 0.95 mass %. The reaction at the surface of the main phase crystal grains will easily occur during the powder metallurgical processes in combination with the additive elements through the amount of B being less than the stoichiometric ratio of basic component $R_2T_{14}B$.

The rare earth based magnet of the present embodiment further contains a trace of additive elements. As the additive elements, well known additive elements can be used. The additive element is preferably those having a eutectic point with the element R (which is the constituent of the main phase crystal grains of $R_2T_{14}B$) in the phase diagram. In this respect, Cu or the like is preferred as the additive element. Also, other elements can be used. The amount of added Cu is 0.01 to 1.5 mass % based on the whole. If the added amount is within this range, Cu will almost unevenly distribute only in the two-grain boundary phases and the crystal boundary phases. On the other hand, as for the element T (which is the constituent of the main phase crystal grains) and Cu, such a combination will hardly have a eutectic point as the phase diagram of, for example. Fe and Cu is monotectic. Therefore, the element M is preferably added which will have a eutectic point in the R-T-M ternary system. As such an element M, it can be Al, Ga, Si, Ge, Sn or the like. In addition, the amount of M is 0.03 to 1.5 mass %. By setting the amount of M within this range, the reaction at the surface of the main phase crystal grains is promoted in the powder metallurgical processes. That is, M reacts with T existing in the two-grain boundary phases so that the generation of the crystal boundary phases containing at least R, T and M can be promoted and the concentration of element T will be decreased in the two-grain boundary phases.

In the rare earth based magnet of the present embodiment, the element T in the basic component $R_2T_{14}B$ has Fe as essential and may also contain other iron family elements. Co is preferred as the iron family element. In this case, the amount of Co is preferably ranges from a level above 0 mass % to a level that is under 3.0 mass %. If Co is contained in the rare earth based magnet, the curie temperature will be elevated and the corrosion resistance will be improved too. The amount of Co may also be 0.3 to 2.5 mass %.

The rare earth based magnet of the present embodiment may also contain C as other elements, and the amount of C is 0.05 to 0.3 mass %. If less C is contained, the coercivity will become insufficient. If more C is contained, the ratio of the value of the magnetic field (Hk) to the coercivity, i.e., the squareness ratio (Hk/coercivity) will become insufficient, where the magnetic field (Hk) is the field when the magnetization becomes 90% of the residual flux density. In order to obtain better coercivity and squareness ratio, the amount of C may also be 0.1 to 0.25 mass %.

The rare earth based magnet of the present embodiment may also contain O as the additional elements, and 0.03 to 0.4 mass % of O can be contained. If less O is contained, the corrosion resistance of the sintered magnet will not be sufficient. If more O is contained, the liquid phase will not be sufficiently formed in the sintered magnet and the coercivity will decrease. In order to obtain better corrosion resistance and coercivity, the amount of O can be 0.05 to 0.3 mass % or 0.05 to 0.25 mass %.

Further, in the sintered magnet of the present embodiment, the amount of N is preferably 0.15 mass % or less. If more N is contained, the coercivity tends to be insufficient.

Preferably, in the sintered magnet of the present embodiment, when the amount of each element falls within the ranges mentioned above and the numbers of C, O and N atoms are respectively referred to as [C], [O] and [N], $[O]/([C]+[N])<0.60$. With such a composition, the absolute value of demagnetization rate at a high temperature can be inhibited to a low level.

In addition, in the sintered magnet of the present invention, the numbers of Nd, Pr, B, C and M atoms follow the correlations below. In other words, when the numbers of Nd. Pr, B, C and M atoms are respectively referred to as [Nd], [Pr], [B], [C] and [M], it is preferable that $0.27<[B]/([Nd]+[Pr])<0.40$ and $0.07<([M]+[C])\ [B]<0.60$. With such a composition, a high coercivity can be maintained.

Hereinafter, an example of the method for preparing the rare earth based magnet of the present embodiment will be described. The rare earth based magnet of the present embodiment can be prepared by a common powder metallugical method which comprises a preparation process for preparing the alloy raw materials, a pulverization process in which fine powers are obtained by pulverizing alloy raw materials, a molding process in which the fine powders are molded to make a molded body, a sintering process in which the molded body is fired to get a sintered body, and a heat treating process in which an aging treatment is applied to the sintered body.

The preparation process is a process in which alloy raw materials having elements contained in the rare earth based magnet of the present embodiment are prepared. First of all, starting metals with specified elements are prepared for the strip casting method and the like. In this way, the alloy raw materials are prepared. The starting metals can be for example the rare earth based metal or the rare earth based alloy, the pure iron, the ferro-boron, or the alloys thereof. These starting metals are used to prepare alloy raw materials from which rare earth based magnets with a desired composition can be obtained.

In the pulverization process, fine powder raw materials are obtained by pulverizing the alloy raw materials obtained from the preparation process. This process is preferably performed in two stages, i.e., the coarse pulverization process and fine pulverization process. Also, this process can be done in one stage. In the coarse pulverization process, for example, the stamp mill, the jaw crusher, the Brown mill and the like can be used under an inert atmosphere. Also, the hydrogen decrepitation can be performed in which pulverization is performed after the hydrogen is adsorbed. In the coarse pulverization process, the alloy raw materials are pulverized until a particle size of several hundreds of micrometers to several millimeters is achieved.

In the fine pulverization process, the coarse powders obtained in the coarse pulverization process are finely pulverized to prepare fine powders with an average particle size of about several micrometers. The average particle size of the fine powders can be set depending on the growth of the sintered crystal grains. The fine pulverization can be performed by using for example a jet mill.

The molding process is a process in which the fine powder raw materials are molded in a magnetic field to make a molded body. Specifically, after the fine powder raw materials are filled in a mold disposed in an electromagnet, the molding is performed by orientating the crystallographic axis of the fine powder raw materials by applying a magnetic field via the electromagnet, while pressurizing the fine powder raw materials. The molding process in the magnetic field can be performed in a magnetic field of for example 1000 to 1600 kA/m under a pressure of about 30 to 300 MPa.

The sintering process is a process in which the molded body is fired to obtain a sintered body. After molded in a magnetic field, the molded body can be fired under vacuum or an inert atmosphere to get a sintered body. Preferably, the firing conditions are properly set based on the composition of the molded body, the pulverization method for getting the fine powders, the grain size or the like. For example, this process may be performed for about 1 to 10 hours at a temperature of 1000° C. to 1100° C.

The heat treating process provides an aging treatment to the sintered body. After this process, the structure of the crystal boundary phases among adjacent main phase crystal grains of $R_2T_{14}B$ is determined. However, the microstructures are determined by not only this process but also the conditions of the sintering process as well as the state of the fine powders. Thus, the correlation between the conditions of the heat treatment and the microstructure of the sintered bodies should be considered while the temperature, duration and the cooling rate in the heat treatment should be set. The heat treatment may be performed at a temperature of 400° C. to 950° C. Alternatively this process can be performed in several stages. For example, a heat treatment around 900° C. is done followed by a heat treatment at about 500° C. The microstructure may also be changed by the cooling rate of the cooling process in the heat treatment, and the cooling rate is preferably 100° C./min or more and especially preferably 300° C./min or more. According to the aging process of the present embodiment, as the cooling rate is larger than that in conventional processes, the uneven distribution of phases with ferromagnetism can be effectively inhibited in the crystal boundary phases. Thus, the causes that lead to the lowered coercivity and deterioration of the demagnetization rate at a high temperature can be eliminated. The structure of the crystal boundary phase can be controlled by variously setting the composition of the alloy raw materials and the conditions for the sintering process and the heat treatment. Here, an example of the heat treating process has been described as a method for controlling the structure of the crystal boundary phases. However, the structure of the crystal boundary phase may also be controlled according to the constituents listed in Table 1.

The rare earth based magnet of the present embodiment can be obtained by the method mentioned above. However, the preparation method of the rare earth based magnets is not limited thereto and can be appropriately changed.

Next, the evaluation of the demagnetization rate at a high temperature for the rare earth based magnet of the present embodiment will be described. The shape of the sample to be evaluated is not particularly restricted and can be one with a permeance coefficient of 2 which is commonly used. First of all, the residual magnetic flux of the sample is measured at room temperature (25° C.) and is set as B0. The residual magnetic flux can be measured by for example a fluxmeter. Then, the sample is exposed to a high temperature of 140° C. for 2 hours and then cooled back to the room temperature. Once upon the temperature of the sample is back to the room temperature, the residual magnetic flux is measured again and set as B1. The demagnetization rate D at a high temperature is evaluated as $D=(B1-B0)/B0\times100$ (%). In addition, a small demagnetization rate at a high temperature in the present invention means the absolute value of the demagnetization rate at a high temperature calculated by the equation above is small.

The microstructure of the rare earth based magnet of the present embodiment (i.e., the composition and area ratios of various crystal boundary phases) can be evaluated via EPMA (wavelength dispersive type energy spectroscopy). An observation is provided to the polished section of the sample whose demagnetization rate at a high temperature has been evaluated. Photos are taken for the sample with a magnification that about 200 main phase grains can be seen at the polished section. Also, the magnification can be determined based on the size or the distribution state of each crystal boundary phase. The polished section can be in parallel to the orientation axis or be orthogonal to the orientation axis or can form any degree with the orientation axis. The section is subjected to a plane analysis via EPMA. Thus, the distribution state of each element becomes clear as well as the distribution states of the main phases and each crystal boundary phase. In addition, each crystal boundary phase contained in the visual field of the plane analysis is subjected to the point analysis via EPMA so that the composition of each crystal boundary phase is determined. In the present specification, the crystal boundary phase containing at least R, T and M in which the concentration of element T is 50 atomic % or more and 80 atomic % or less is deemed as the R-T-M based compound, and the area ratio of the R-T-M based compound is calculated based on the results of plane analysis and point analysis via EPMA. When the area ratio of the R-T-M based compound is calculated and is adjusted into a specific range, the concentration of T in the R-T-M based compound can be 50 atomic % or more and 80 atomic % or less. A series of measures are provided to multiple (≥3) sections of the magnet sample, and the area ratio of R-T-M based compound in the whole observed visual field is calculated as the representative value of the area ratio. In addition, the average of the composition of the R-T-M based compound is obtained as the representative value of the composition of the R-T-M based compound.

Hereinafter, the present invention will be more specifically described based on specific examples. However, the present invention is not limited to these examples.

EXAMPLES

First of all, the starting metals for the sintered magnet were prepared and then subjected to the strip casting method. In this way, each alloy raw materials was prepared, wherein the compositions of the sintered magnets of Examples 1 to 10 shown in Table 1 can be obtained. In addition, as for the amount of each element shown in Table 1, the amounts of T, R, Cu and M were measured by the X-Ray fluorescence spectrometry and that of B was measured by the ICP atomic emission spectroscopy. Further, the amount of O can be measured by an inert gas fusion-nondispersive infrared absorption method, and that of C can be measured by a combustion in oxygen flow-infrared absorption method. As for N, the amount can be measured by the inert gas fusion-thermal conductivity method. In addition, with respect to [O]/([C]+[N]), [B]/([Nd]+[Pr]) and ([M]+[C])/[B], the number of atoms of each element was determined based on the amount obtained via these methods.

Next, after the hydrogen was adsorbed to the obtained alloy raw materials, the hydrogen decrepitation process was performed with hydrogen releasing at 600° C. under Ar atmosphere for 1 hour. Then, the resultant pulverized substances were cooled to room temperature under Ar atmosphere.

Oleic amides as the pulverization agent were added to the pulverized substances and then mixed. Thereafter, a jet mill was used to perform the fine pulverization so that powder raw materials were obtained with an average particle size of 3 μm.

The resultant powder raw materials were molded under a low-oxygen atmosphere at a magnetic field for orientation of 1200 kA/m with a molding pressure of 120 MPa. In this respect, a molded body was obtained.

The molded body was fired under vacuum at 1030 to 1050° C. for 2 to 4 hours. Then, the molded body was quickly cooled to obtain a sintered body. The obtained sintered body was subjected to a heat treatment with two stages. The first stage (the heat treatment at 900° C.) (aging 1) and the second stage (the heat treatment at 500° C.) (aging 2) were respectively performed for 1 hour. As for the heat treatment of the second stage (aging 2), the cooling rate was changed to prepare multiple samples with different growth state of the crystal boundary phase. Further, as mentioned above, the growth of the crystal boundary phase would change depending on the composition of the alloy raw materials and the conditions of the sintering process and the heat treatment.

For the samples obtained above, a B-H tracer was used to measure the residual flux density and the coercivity. Then, the demagnetization rate at a high temperature was measured. For each sample whose magnetic properties had been measured, the polished sections were observed via EPMA to identify the crystal boundary phases and to evaluate the area ratio and composition of each crystal boundary phase at the polished section. The magnetic properties of each sample were shown in Table 1. In addition, based on the representative values of the composition of R-T-M based compound for each sample, the atomic ratios of R, T and M were used as the relative atomic ratios of R, T and M. The results were shown in Table 2. Also, the representative value for the area ratio of the R-T-M based compound was listed in Table 2. Further, based on the analysis via the high resolution transmission electron microscopy and the electron diffraction patterns at room temperature, the R-T-M based compound which was a crystal and belonged to the tetragonal crystal system was represented by the symbol '○' and other R-T-M based compounds were represented by the symbol 'x' in Table 2 Similarly, based on the analysis via the high resolution transmission electron microscopy and the electron diffraction patterns, the R-T-M based compound which was a crystal with Bravais lattices (which were body centered tetragonal lattices) was represented by the symbol '○' and other R-T-M based compounds were represented by the symbol 'x' in Table 2. Also, the length of the c axis in the unit lattice of the R-T-M based compound which was calculated from the images of high resolution transmission electron microscopy and the electron diffraction was listed in Table 2. Similarly, based on the analysis via the high resolution transmission electron microscopy and the electron diffraction patterns, the R-T-M based compound which was a crystal having the $La_6Co_{11}Ga_3$ type crystal structure was represented by the symbol '○' and other R-T-M based compounds were represented by the symbol 'x' in Table 2. Further, when the numbers of R, T and M atoms contained in the R-T-M based compound were respectively referred as [R], [T] and [M], the ratio of [R] to [M](i.e., [R]/[M]) and the ratio of [T] to [M]([T]/[M]) were calculated from the relative atomic ratios of R, T and M and were listed in Table 2. Further, the graph showing the correlation between the demagnetization rate at a high temperature and the value of [R]/[M] for each sample was shown in FIG. 3. Besides, the graph showing the correlation between the demagnetization rate at a high temperature and the value of [T]/[M] for each sample was shown in FIG. 4. In addition, in Tables 1 and 2 and FIGS. 3 and 4, the samples with the conventional microstructure (samples 9 and 10) were used in Comparative Examples.

When the numbers of C, O, N, Nd, Pr, B and M atoms contained in the sintered article were respectively referred to as [C], [O], [N], [Nd], [Pr], [B] and [M], the values of [O]/([C]+[N]), [B]/([Nd]+[Pr]) and ([M]+[C])/[B] were calculated for each sample and listed in Table 3.

TABLE 1

| Sample | Composition of sintered magnet (mass %) | | | | | | | | | | | | | | | Firing process | | Aging 2 Cooling Rate | Magnetic properties | | Demagnetization rate at a high temperature |
|---|---|---|---|---|---|---|---|---|---|---|---|---|---|---|---|---|---|---|---|---|---|
| | R | | | | | | M | | | | | | | | | Temp | Time | ° C./ | Br | Hcj | |
| No. | Sum | Nd | Pr | Dy | B | Cu | Al | Ga | Si | Ge | Sn | Fe | N | C | O | ° C. | hr | min | kG | kOe | % |
| Sample 1 | 30.5 | 23.0 | 7.5 | | 0.90 | 0.1 | 0.2 | 0.2 | | | | bal. | 0.06 | 0.12 | 0.09 | 1030 | 4 | 100 | 13.9 | 16.8 | −1.1 |
| Sample 2 | 32.0 | 26.0 | 6.0 | | 0.86 | 0.2 | 0.1 | 0.5 | | | | bal. | 0.04 | 0.12 | 0.09 | 1040 | 3 | 300 | 13.8 | 19.1 | −0.9 |
| Sample 3 | 31.5 | 25.0 | 6.5 | | 0.85 | 0.3 | 0.2 | 0.6 | | | | bal. | 0.04 | 0.09 | 0.05 | 1050 | 2 | 300 | 13.8 | 23.3 | −0.5 |
| Sample 4 | 32.0 | 32.0 | | | 0.83 | 0.1 | 0.2 | | 0.3 | | | bal. | 0.04 | 0.10 | 0.09 | 1030 | 4 | 100 | 13.7 | 19.5 | −0.9 |
| Sample 5 | 32.0 | 32.0 | | | 0.83 | 0.1 | 0.2 | | | 0.3 | | bal. | 0.06 | 0.10 | 0.09 | 1030 | 4 | 100 | 13.7 | 19.2 | −1.0 |
| Sample 6 | 32.0 | 32.0 | | | 0.83 | 0.1 | 0.2 | | | | 0.3 | bal. | 0.05 | 0.11 | 0.09 | 1030 | 4 | 100 | 13.7 | 19.4 | −0.8 |
| Sample 7 | 32.0 | 31.0 | | 1.0 | 0.83 | 0.1 | 0.2 | 0.5 | | | | bal. | 0.04 | 0.09 | 0.06 | 1030 | 4 | 650 | 13.5 | 24.0 | −0.3 |
| Sample 8 | 31.5 | 24.0 | 7.5 | | 0.93 | 0.2 | 0.2 | 0.2 | | | | bal. | 0.04 | 0.09 | 0.11 | 1030 | 4 | 500 | 13.9 | 15.9 | −2.9 |
| Sample 9 | 30.5 | 23.0 | 7.5 | | 1.00 | 0.1 | 0.2 | 0.2 | | | | bal. | 0.04 | 0.09 | 0.12 | 1030 | 4 | 40 | 14.0 | 14.8 | −4.4 |

TABLE 1-continued

| Sample No. | Composition of sintered magnet (mass %) R Sum | Nd | Pr | Dy | B | Cu | M Al | Ga | Si | Ge | Sn | Fe | N | C | O | Firing process Temp ° C. | Time hr | Aging 2 Cooling Rate ° C./min | Magnetic properties Br kG | Hcj kOe | Demagnetization rate at a high temperature % |
|---|---|---|---|---|---|---|---|---|---|---|---|---|---|---|---|---|---|---|---|---|---|
| Sample 10 | 30.5 | 23.0 | 7.5 | | 0.94 | 0.1 | 0.2 | 0.2 | | | | bal. | 0.04 | 0.10 | 0.11 | 1030 | 4 | 10 | 14.0 | 14.1 | −4.3 |

TABLE 2

| Sample No. | R-T-M based compound Concentration of R, T and M atomic % R | T | M | Relative atomic ratio of R, T and M % R | T | M | Atomic ratio [R]/[M] | [T]/[M] | Area ratio % | Crystal system Tetragonal crystal system | Bravais lattice Body centered tetragonal lattice | Length of c axis Å | Crystal structure $La_6Co_{11}Ga_3$ type |
|---|---|---|---|---|---|---|---|---|---|---|---|---|---|
| Sample 1 | 29.4 | 63.5 | 4.4 | 30.2 | 65.3 | 4.5 | 6.8 | 14.6 | 0.7 | ○ | ○ | 23 | ○ |
| Sample 2 | 29.7 | 63.9 | 4.9 | 30.1 | 64.9 | 5.0 | 6.0 | 13.0 | 4.4 | ○ | ○ | 24 | ○ |
| Sample 3 | 28.7 | 64.3 | 4.8 | 29.3 | 65.8 | 5.0 | 5.9 | 13.3 | 6.1 | ○ | ○ | 22 | ○ |
| Sample 4 | 32.4 | 60.3 | 3.9 | 33.5 | 62.4 | 4.0 | 8.3 | 15.5 | 2.1 | ○ | ○ | 23 | ○ |
| Sample 5 | 26.4 | 61.3 | 2.9 | 29.1 | 67.7 | 3.2 | 9.1 | 21.1 | 1.9 | ○ | ○ | 21 | ○ |
| Sample 6 | 29.3 | 58.1 | 3.3 | 32.3 | 64.1 | 3.6 | 8.9 | 17.6 | 1.3 | ○ | ○ | 21 | ○ |
| Sample 7 | 28.9 | 59.9 | 4.1 | 31.1 | 64.5 | 4.4 | 7.0 | 14.6 | 0.3 | ○ | ○ | 22 | ○ |
| Sample 8 | 29.3 | 63.0 | 4.7 | 30.2 | 64.9 | 4.8 | 6.2 | 13.4 | 0.1 | ○ | ○ | 23 | ○ |
| Sample 9 | 20.2 | 64.4 | 1.0 | 23.6 | 75.3 | 1.1 | 21.0 | 67.0 | less than 0.1 | ○ | ○ | 12 | x |
| Sample 10 | 19.7 | 69.5 | 1.2 | 21.8 | 76.9 | 1.3 | 16.4 | 57.9 | less than 0.1 | x | x | 12 | x |

TABLE 3

| Sample No. | Atomic ratio [B]/([Nd] + [Pr]) | ([M] + [C])/[B] | [O]/([C] + [N]) |
|---|---|---|---|
| Sample 1 | 0.39 | 0.24 | 0.40 |
| Sample 2 | 0.36 | 0.26 | 0.45 |
| Sample 3 | 0.36 | 0.30 | 0.30 |
| Sample 4 | 0.35 | 0.34 | 0.51 |
| Sample 5 | 0.35 | 0.26 | 0.45 |
| Sample 6 | 0.35 | 0.25 | 0.45 |
| Sample 7 | 0.36 | 0.29 | 0.36 |
| Sample 8 | 0.39 | 0.21 | 0.67 |
| Sample 9 | 0.43 | 0.19 | 0.73 |
| Sample 10 | 0.41 | 0.21 | 0.62 |

It can be known from Table 1 that the absolute values of demagnetization rates at a high temperature in samples of Examples 1 to 8 were lower than 4%. In other words, the absolute values of demagnetization rates were inhibited to a low level so these samples became rare earth based magnets that can be used at high temperature environments. In the samples 9 and 10 which had conventional microstructures, the absolute values of demagnetization rates at a high temperature were 4% and more. That was, the demagnetization rates at a high temperature were not inhibited. As for the R-T-M based compound observed at any sections of samples 1 to 8, the value of saturation magnetization was determined to be 5% or less of that of $Nd_2Fe_{14}B$ compound after the analysis of magnetic flux distribution based on the electron holography, suggesting that the R-T-M based compound was a phase not exhibiting ferromagnetism. Thus, the inhibitory effect on the demagnetization rate at a high temperature of sample 1 to 8 was achieved by containing the R-T-M based compound therein. Similarly, based on analysis via electron holography, it can be known that crystal boundary phases with a value of saturation magnetization being 4% or less when compared to the phase of $Nd_2Fe_{14}B$ compound were present in samples 1 to 7.

Figure 3:
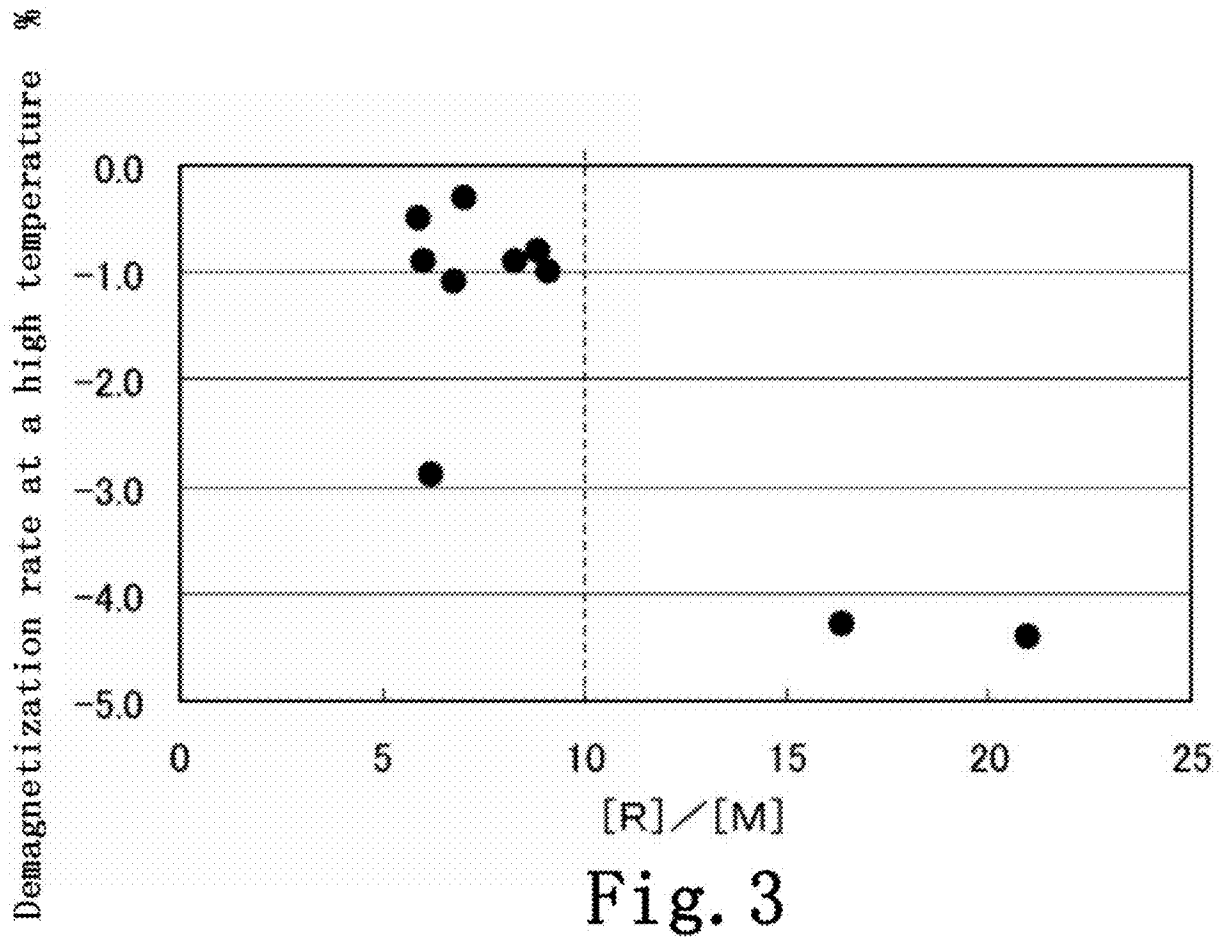
FIG. 3 is a graph showing the correlation between [R]/[M] and the demagnetization rate at a high temperature in the present embodiment.

In addition, as shown in FIG. 3, when [R]/[M]<10, the coercivity (Hcj) can be effectively improved.

Figure 4:
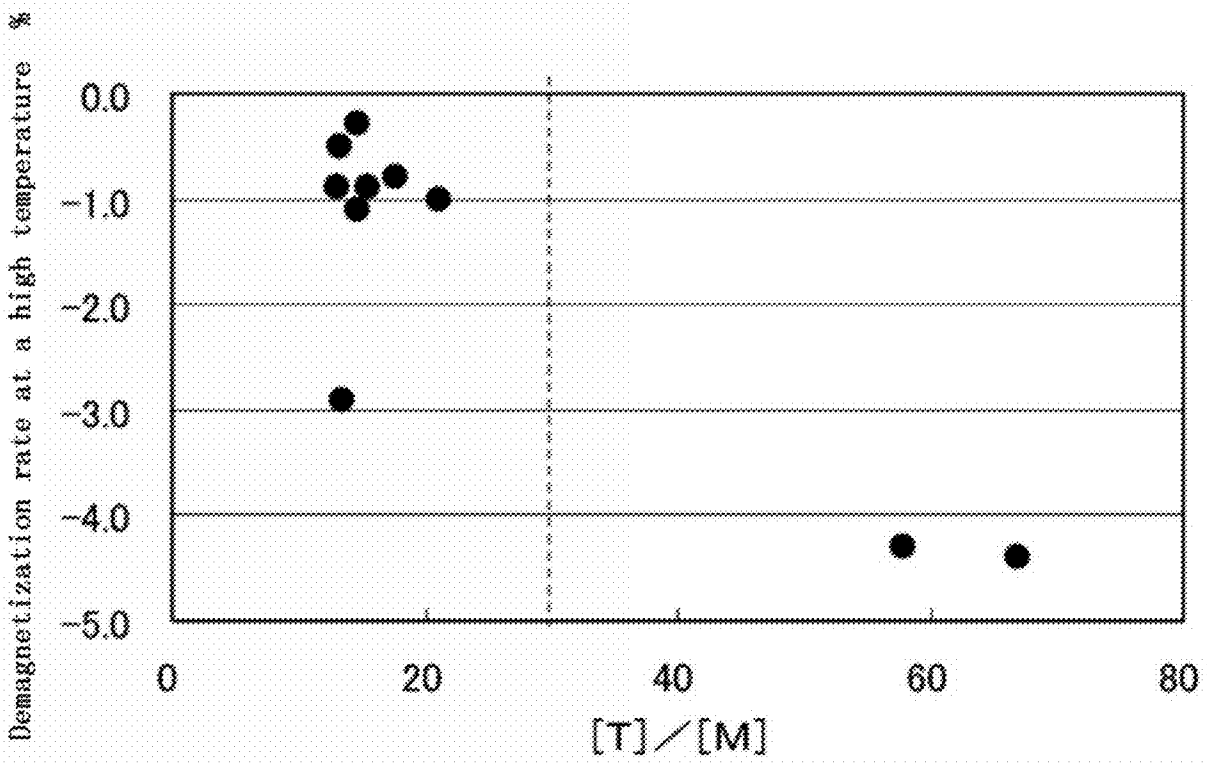
FIG. 4 is a graph showing the correlation between [T]/[M] and the demagnetization rate at a high temperature in the present embodiment.

Further, as shown in FIG. 4, when [T]/[M]<30, the coercivity (Hcj) can be effectively improved.

Then, it can be known from Table 2 that the area ratio of the R-T-M based compound in the section was preferably 0.1% or more for that the absolute value of the demagnetization rate at a high temperature would be 3% or less under such case. Further, the area ratio was preferred to be large only from the viewpoint of the demagnetization rate at a high temperature. However, if other properties such as the residual flux density were considered, it was practical when the area ratio is less than 20%.

Further, it can be known from Table 2 that the R-T-M based compound was preferably a crystal belonging to the tetragonal crystal system for that the absolute value of the demagnetization rate at a high temperature would be 3% or less under such case.

Based on Table 2, it was known that the R-T-M based compound was preferably a crystal having Bravais lattices (which were body centered tetragonal lattices) for that the absolute value of the demagnetization rate at a high temperature would be 3% or less under such case.

In addition, it can be known from Table 2 that the R-T-M based compound was preferably a crystal with the length of the c axis in the unit lattice being 21 to 23 Å at room temperature for that the absolute value of the demagnetization rate at a high temperature would be 3% under such case.

Further, it can be known from Table 2 that the R-T-M based compound preferably had the $La_6Co_{11}Ga_3$ type crystal structure for that the absolute value of the demagnetization rate at a high temperature would be 3% or less under such case.

In addition, as shown in Table 3, in samples 1 to 8 which met the requirements of the present invention, the R-T-M based compound mentioned above was contained in the sintered magnet, and the numbers of Nd, Pr, B, C and M atoms contained in the sintered magnet satisfied the following specific correlations. That was, when the numbers of Nd, Pr, B, C and M atoms were referred to as [Nd], [Pr], [B], [C] and [M], $0.27<[B]/([Nd]+[Pr])<0.40$ and $0.07<([M]+[C])/[B]<0.60$. Thus, as $0.27<[B]/([Nd]+[Pr])<0.40$ and $0.07<([M]+[C])/[B]<0.60$, the coercivity (Hcj) can be effectively improved.

Further, as shown in Table 3, in samples 1 to 8 which met the requirements of the present invention, the sintered magnet contained the R-T-M based compound, and the numbers of O, C and N atoms contained in the sintered magnet satisfied the following specific correlations. That was, when the maunders of O, C and N atoms were referred to as [O], [C] and [N]. $[O]/([C]+[N])<0.60$. Thus, as $[O]/([C]+[N])<0.60$, the demagnetization rate D at a high temperature can be effectively inhibited.

As described in these examples, in the rare earth based magnet of the present invention, the R-T-M based crystal compound having R, T and M elements formed crystal boundary phases of non-ferromagnetism in the sintered body by containing the rare earth element R, iron family element T and M (which formed the ternary eutectic point with R and T) in the crystal boundary phases which were subjected to a proper aging treatment and satisfied the correlations mentioned above. As a result, the concentration of T in the two-grain boundary phases can be lowered so that the two-grain boundary phases became a crystal boundary phase of non-ferromagnetism. In this way, the effect on cutting off the magnetic coupling between adjacent $R_2T_{14}B$ main phase crystal grains can be improved so that the demagnetization rate at a high temperature was inhibited to a low level.

The present invention has been disclosed based on the embodiments mentioned above. These embodiments are only illustrative and can be modified and changed within the scope of the claims of the present invention. Further, those skilled in the art will realize that these modifications and changes are within the scope of claims of the present invention. Thus, the description in the specification and the drawings should be considered as illustrative but not limited.

According to the present invention, a rare earth based magnet which can be used at a high temperature environment can be provided.

DESCRIPTION OF REFERENCE NUMERALS

1 main phase crystal grain
2 two-grain boundary phase
3 crystal boundary phase

What is claimed is:

1. A rare earth based magnet comprising $R_2T_{14}B$ main phase crystal grains and crystal boundary phases, the crystal boundary phases including crystal boundary phases containing at least R, T and M with the relative atomic ratios of R, T and M in the following ranges:

R: 25 to 35 atomic %;
T: 60 to 70 atomic %; and,
M: 2 to 10 atomic %, where R represents the rare earth element, T represents at least one iron family element with Fe as essential, and M represents at least one element selected from the group consisting of Al, Ge, Si, Sn and Ga, wherein a sum of heavy rare earth elements accounts for 1.0 mass % or less based on a total mass of the rare earth based magnet, the crystal boundary phases containing at least R, T and M are R-T-M based compounds, an area ratio of the R-T-M based compound relative to a total base material ranges from a level of 1.3% or more to 6.1% or less at any section having about 200 main phase grains, and an absolute value of a demagnetization rate at a high temperature is inhibited to 3% or less.

2. The rare earth based magnet of claim 1, wherein in the crystal boundary phases containing at least R, T and M, when the numbers of R, T and M atoms are respectively referred to as [R], [T] and [M], $[R]/[M]<10$ and $[T]/[M]<30$.

3. The rare earth based magnet of claim 1, wherein the R-T-M based compound is a crystal belonging to the tetragonal crystal system.

4. The rare earth based magnet of claim 1, wherein the R-T-M based compound is a crystal having body centered tetragonal lattices.

5. The rare earth based magnet of claim 1, wherein in the R-T-M based compound, the length of the c axis in the unit lattice is in a range of 21 to 23 Å.

6. The rare earth based magnet of claim 1, wherein the R-T-M based compound has $La_6Co_{11}Ga_3$ type crystal structure.

7. The rare earth based magnet of claim 1, wherein the rare earth based magnet contains Nd, Pr, B, C, and M, and the numbers of Nd, Pr, B, C, and M atoms contained in the rare earth based magnet are referred to as [Nd], [Pr], [B], [C] and [M], in which $0.27<[B]/([Nd]+[Pr])<0.40$ and $0.07<([M]+[C])/[B]<0.60$.

8. The rare earth based magnet of claim 1, wherein the rare earth based magnet contains O, C, and N, and the numbers of O, C, and N atoms contained in the rare earth based magnet are referred to as [O], [C], and [N], in which $[O]/([C]+[N])<0.60$.

9. The rare earth based magnet of claim 1, wherein the sum of the heavy rare earth elements accounts for 0.5 mass % or less based on the total mass of the rare earth based magnet.

10. The rare earth based magnet of claim 1, wherein the rare earth based magnet contains Cu, and an amount of each element relative to the total mass is as follows:

R: 29.5 to 33 mass %;
B: 0.7 to 0.95 mass %;
M: 0.03 to 1.5 mass %;
Cu: 0.01 to 1.5 mass %;
Fe: balance, substantially; and
a total content of elements other than Fe occupying the balance: 5 mass % or less.

* * * * *